US011391507B2

(12) United States Patent
Vijayan

(10) Patent No.: US 11,391,507 B2
(45) Date of Patent: Jul. 19, 2022

(54) REFRIGERATOR APPLIANCE WITH ARTICULATING HORIZONTAL MULLION

(71) Applicant: Haier US Appliance Solutions, Inc., Wilmington, DE (US)

(72) Inventor: Vineeth Vijayan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/103,002

(22) Filed: Nov. 24, 2020

(65) Prior Publication Data

US 2022/0163252 A1 May 26, 2022

(51) Int. Cl.
*F25D 23/02* (2006.01)
*F25D 23/06* (2006.01)
*F25D 25/02* (2006.01)

(52) U.S. Cl.
CPC ..... *F25D 23/069* (2013.01); *F25D 23/028* (2013.01); *F25D 25/025* (2013.01); *F25D 2500/02* (2013.01)

(58) Field of Classification Search
CPC ..... F25D 23/028; F25D 23/069; F25D 25/025
See application file for complete search history.

(56) References Cited

U.S. PATENT DOCUMENTS

| | | | | |
|---|---|---|---|---|
| 5,694,789 | A * | 12/1997 | Do | F25D 23/02 312/405 |
| 8,172,346 | B2 * | 5/2012 | Tafoya | D06F 37/267 312/404 |
| 9,163,870 | B2 * | 10/2015 | Jeon | F25D 23/028 |
| 9,739,524 | B2 * | 8/2017 | Giacomini | F25D 23/04 |
| 9,939,191 | B2 * | 4/2018 | Giacomini | F25D 23/087 |
| 10,422,571 | B2 * | 9/2019 | Scalf | F25D 23/02 |
| 10,982,897 | B2 * | 4/2021 | Reuter | F25D 23/028 |
| 10,995,977 | B2 * | 5/2021 | Ayyawar | F25D 23/028 |
| 2011/0018413 | A1 * | 1/2011 | Tafoya | D06F 37/267 312/296 |
| 2019/0145698 | A1 * | 5/2019 | Scalf | F25D 23/02 62/466 |
| 2020/0018539 | A1 * | 1/2020 | Scalf | F25D 23/069 |
| 2020/0318889 | A1 * | 10/2020 | Reuter | F25D 11/02 |

* cited by examiner

*Primary Examiner* — Kimberley S Wright
(74) *Attorney, Agent, or Firm* — Dority & Manning, P.A.

(57) ABSTRACT

A refrigerator appliance includes a cabinet. A fresh food chamber and a freezer chamber are defined in the cabinet. The fresh food chamber and the freezer chamber are mutually separated by a mullion. The refrigerator appliance also includes an articulating lip coupled to the mullion. The articulating lip is movable relative to the mullion between a sealing position and an open position.

17 Claims, 7 Drawing Sheets

REFRIGERATOR APPLIANCE WITH ARTICULATING HORIZONTAL MULLION

FIELD OF THE INVENTION

The present disclosure relates generally to refrigerator appliances and more particularly to refrigerator appliances with features for sealing one or more chilled chambers therein while minimizing encroachment on storage volume within the chilled chamber or chambers.

BACKGROUND OF THE INVENTION

Refrigerator appliances generally include a cabinet that defines chilled chambers for receipt of food items for storage. One or more insulated, sealing doors are provided for selectively enclosing the chilled food storage chambers. Consumers generally prefer chilled chambers that facilitate visibility and accessibility of food items stored therein.

The sealing doors typically sealingly engage with corresponding surfaces of the cabinet. However, the provision of these corresponding surfaces may result in increased thickness of partitions of the refrigerator appliance in order to provide sufficient surface area for sealing. The increased thickness comes at a cost of reduced storage volume within the cabinet.

Accordingly, a refrigerator appliance with features for sealing engagement with the doors and increased storage volume would be useful.

BRIEF DESCRIPTION OF THE INVENTION

Aspects and advantages of the invention will be set forth in part in the following description, or may be apparent from the description, or may be learned through practice of the invention.

In an exemplary embodiment, a refrigerator appliance is provided. The refrigerator appliance defines a vertical direction, a lateral direction and a transverse direction. The vertical, lateral and transverse directions are mutually perpendicular. The refrigerator appliance also includes a cabinet extending from a top to a bottom along the vertical direction. The cabinet also extends from a left side to a right side along the lateral direction. The cabinet defines a fresh food storage chamber and a freezer chamber. The fresh food storage chamber and the freezer chamber are mutually separated by a mullion. The refrigerator appliance also includes a drawer slidably mounted within the fresh food chamber such that the drawer is movable along a path of travel between a retracted position and an extended position. An articulating lip is coupled to the mullion. The articulating lip is movable relative to the mullion between a sealing position wherein the articulating lip is in the path of travel of the drawer and an open position wherein the articulating lip is outside of the path of travel of the drawer.

In another exemplary embodiment, a refrigerator appliance is provided. The refrigerator appliance defines a vertical direction, a lateral direction and a transverse direction. The vertical, lateral and transverse directions are mutually perpendicular. The refrigerator appliance also includes a cabinet extending from a top to a bottom along the vertical direction. The cabinet also extends from a left side to a right side along the lateral direction. The cabinet defines a fresh food storage chamber and a freezer chamber. The fresh food storage chamber and the freezer chamber are mutually separated by a mullion. The refrigerator appliance also includes a door movably mounted to the cabinet whereby the door is movable between a closed position where the door sealingly encloses at least a portion of one of the fresh food chamber and the freezer chamber and an open position to permit access to the one of the fresh food chamber and the freezer chamber. A gasket is mounted to the door. An articulating lip is coupled to the mullion. The articulating lip includes a bearing surface. The articulating lip is movable relative to the mullion between a sealing position and an open position and the gasket mounted to the door sealingly engages the bearing surface of the articulating lip when the articulating lip is in the sealing position and the door is in the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
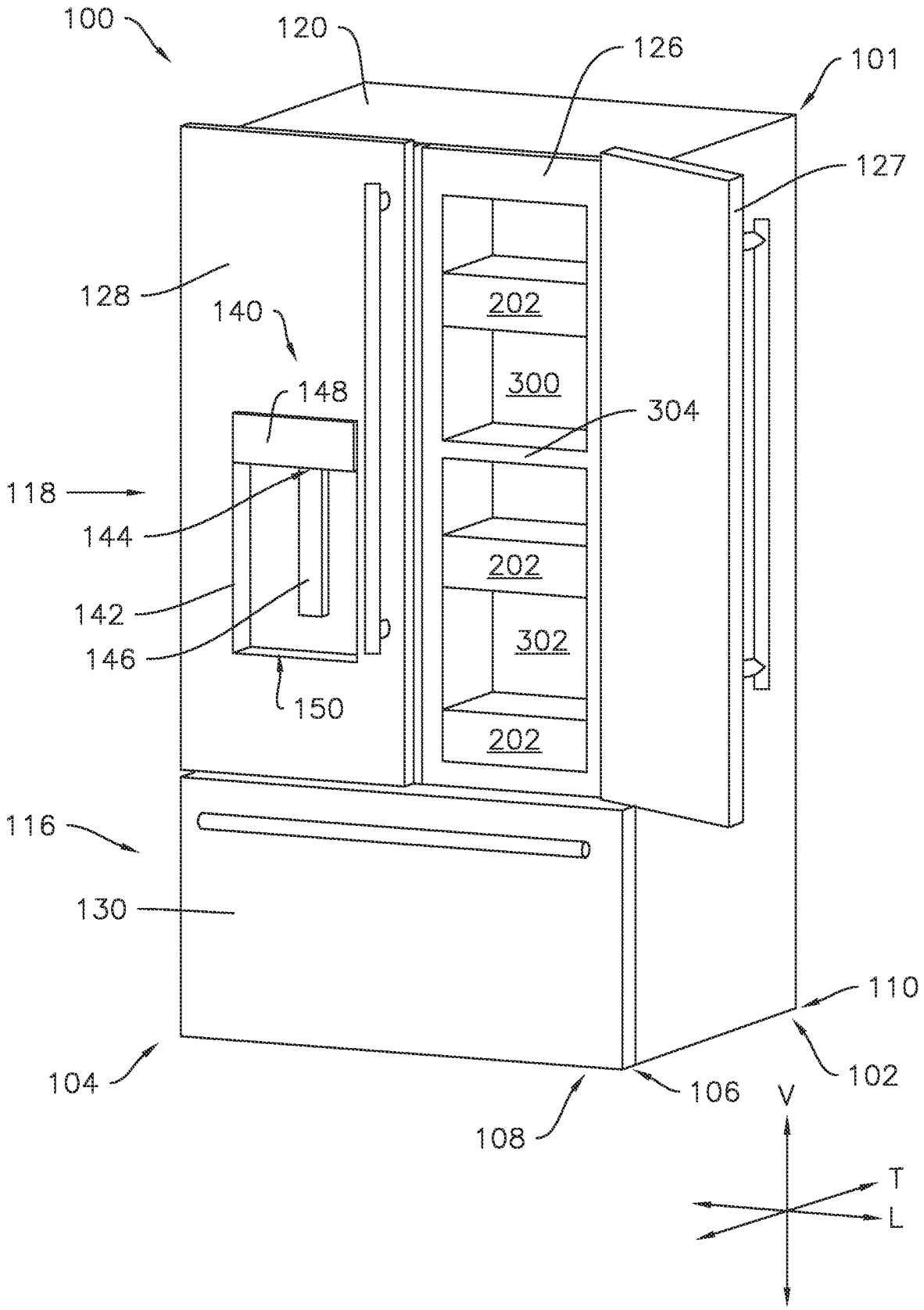
FIG. 1 provides a perspective view of an exemplary refrigerator appliance according to one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
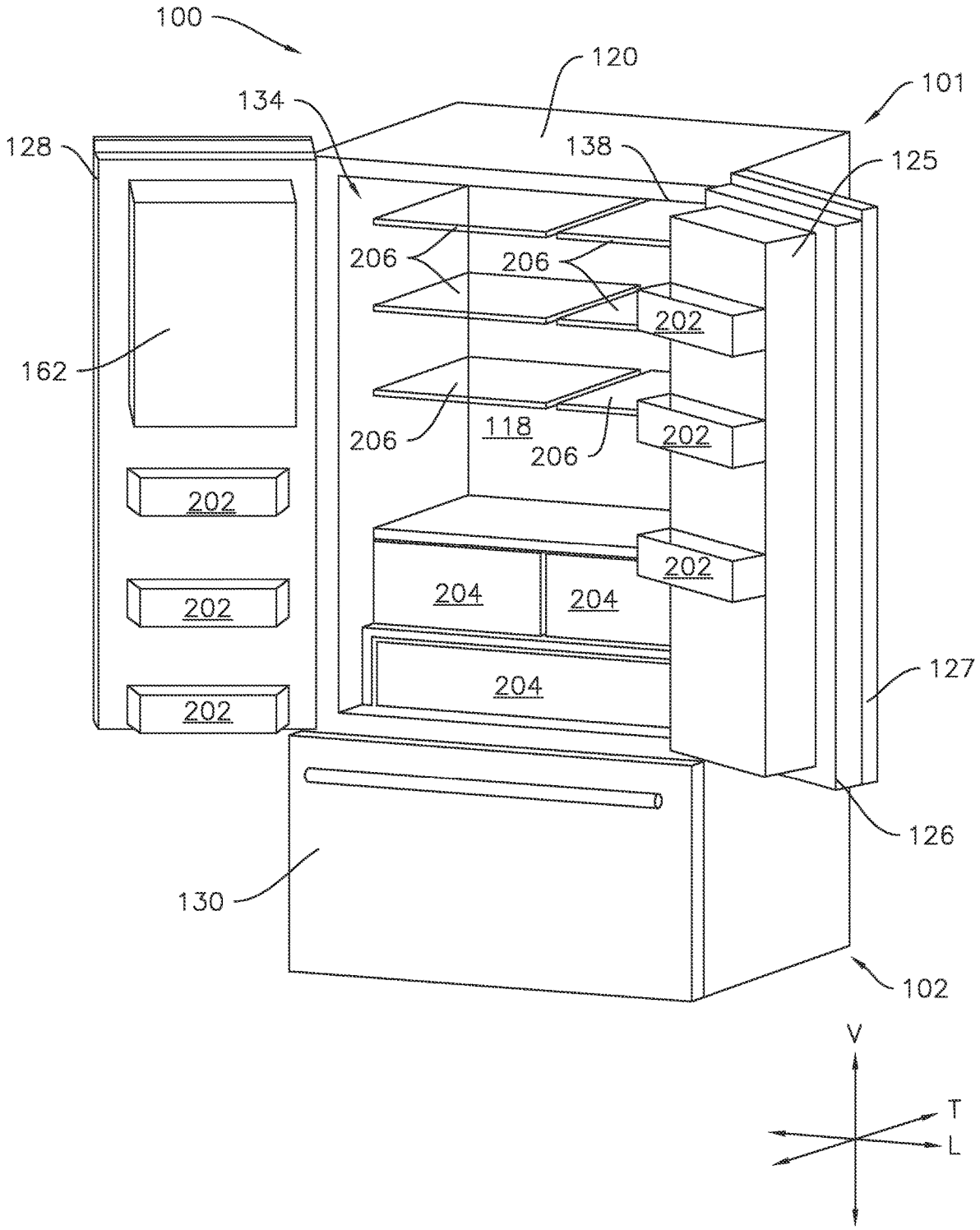
FIG. 2 provides a view of the refrigerator appliance of FIG. 1 with a left door and a right door both in an open position.

FIGS. 1 and 2 provide perspective views of an exemplary refrigerator appliance 100 according to one or more embodiments of the present subject matter with doors 126, 128 (described in more detail below) in various positions. Refrigerator appliance 100 defines a vertical direction V, a lateral direction L, and a transverse direction T, each mutually perpendicular to one another. As may be seen in FIGS. 1 and 2, refrigerator appliance 100 includes a cabinet or housing 120 that extends between a top 101 and a bottom 102 along a vertical direction V, between a left side 104 and a right side 106 along the lateral direction L, and between a front 108 and a rear 110 along the transverse direction T. Housing 120 defines a chilled chamber 118 (FIG. 2) for receipt of food items for storage. As used herein, the chamber may be "chilled" in that the chamber is operable at temperatures below room temperature, e.g., less than about seventy-five degrees Fahrenheit (75° F.).

Figure 3:
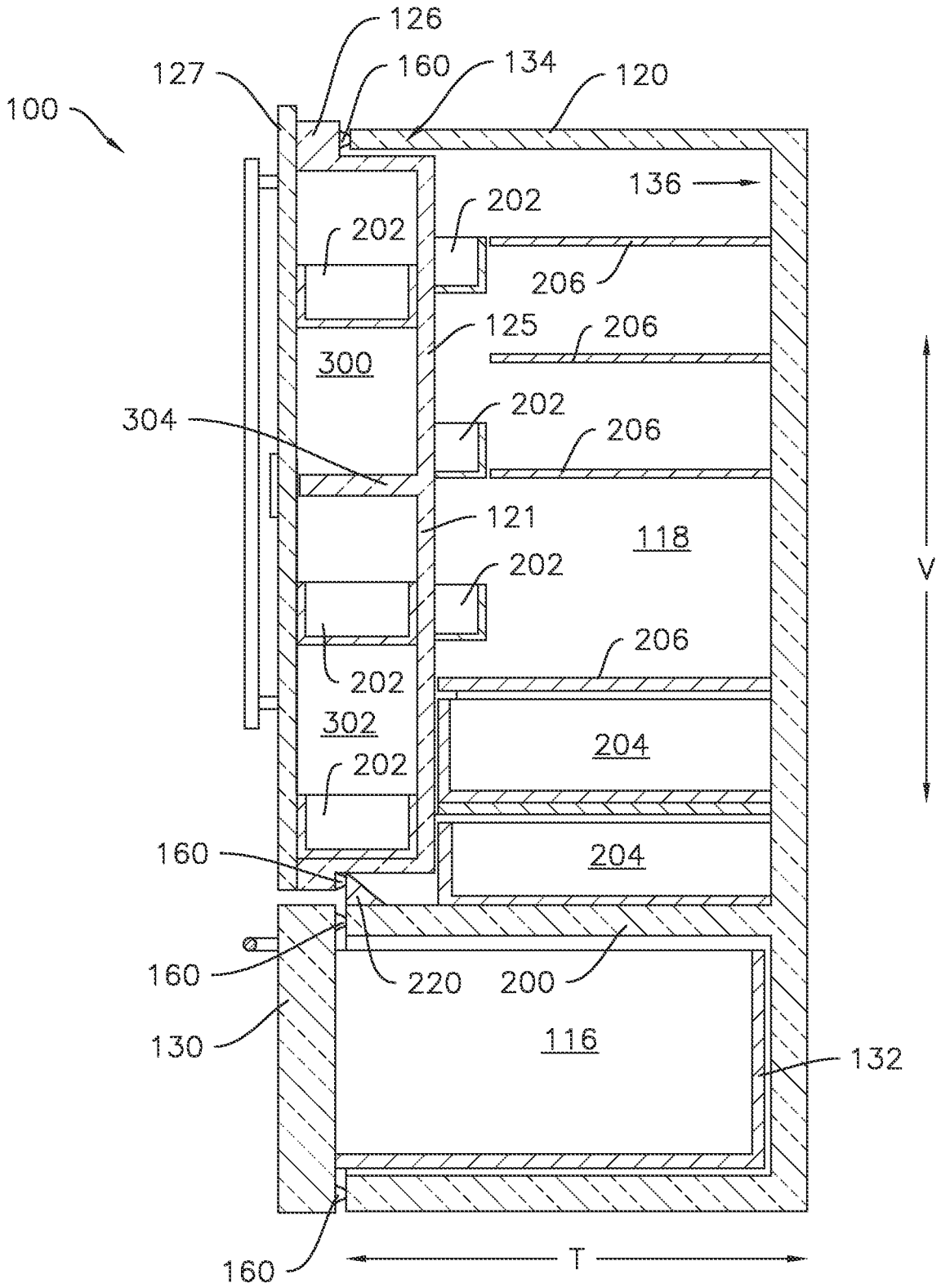
FIG. 3 provides a right side section view of the refrigerator appliance of FIG. 1.

As may be seen in FIG. 2, the chilled chamber 118 extends along the vertical direction V between the top 101 and the bottom 102 of the cabinet 120 and along the lateral direction L between the left side 104 and the right side 106 of the cabinet 120. The chilled chamber 118 also extends along the transverse direction T between a front portion 134 and a back portion 136 (FIG. 3). The front portion 134 of the chilled chamber 118 defines an opening 138 for receipt of food items.

In some embodiments, the chilled chamber 118 may be, e.g., a fresh food storage chamber 118 as shown in FIGS. 1 through 3. In such embodiments, a second chilled chamber, e.g., a separate freezer chamber 116, may be provided in the cabinet 120. For example, the refrigerator appliance 100 may include the freezer chamber 116 below the fresh food storage chamber 118, as illustrated for example in FIGS. 1 through 3.

As shown for example in FIG. 2, various storage components may be mounted within the chilled chamber 118 to facilitate storage of food items therein as will be understood by those skilled in the art. In particular, the storage components may include various combinations of bins 202, drawers 204, and shelves 206 mounted within the chilled chamber 118 and/or one or both flexible chambers 300 and 302 (FIG. 1). Bins 202, drawers 204, and shelves 206 are configured for receipt of food items (e.g., beverages and/or solid food items) and may assist with organizing such food items.

Refrigerator doors 126 and 128 are rotatably mounted, e.g., hinged, to an edge of housing 120 for selectively accessing the chilled chamber 118 within the housing 120. Refrigerator doors 126 and 128 may be mounted to the housing 120 at or near a front portion 134 of the chilled chamber 118 such that the doors 126 and 128 rotate between a closed position (FIG. 1) and an open position (FIG. 2). In the closed position, the doors 126 and 128 cooperatively sealingly enclose the chilled chamber 118. Additionally, one or more gaskets 160 and other sealing devices (FIG. 3), may be provided to promote sealing between the doors 126 and 128 and the cabinet 120. In the open position the doors 126 and 128 permit access to the chilled chamber 118. In embodiments where a separate freezer chamber 116 is provided, the freezer chamber 116 may be spaced apart from the fresh food chamber 118 along the vertical direction V. For example, the freezer chamber 116 may be positioned below the fresh food chamber 118, as illustrated, or may be positioned above the fresh food chamber 118, e.g., in a top mount configuration. A freezer door 130 may be arranged adjacent to, e.g., below, refrigerator doors 126 and 128 for selectively accessing freezer chamber 116. Freezer door 130 may be coupled to a freezer drawer 132 (FIG. 3) slidably mounted within freezer chamber 116. Freezer door 130 may also be provided with one or more gaskets 160 to promote sealing between the freezer door 130 and the cabinet 120. The doors 126 and 128 may be generally mirrored, e.g., the overall shape and size of each door 126 or 128 may be the same as the other door 126 or 128, with possible internal variations such as the dispenser recess 150 described below. Moreover, although not specifically shown, the doors 126 and 128 are independently rotatable such that, e.g. the right door 126 may be in the open position while the left door 128 is in the closed position, or vice versa.

As may be seen in FIG. 1, refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 126 and 128, such as left door 128 as in the illustrated exemplary embodiment. Dispenser 142 includes a discharging outlet 144 for accessing ice and liquid water. For example, ice may be stored in an ice box 162 (FIG. 2) in one of the doors 126 or 128. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned on an exterior side of one of the refrigerator doors 126 and 128, e.g., left door 128 as in the illustrated example embodiment, at a predetermined elevation convenient for a user to access ice or water and enabling the user to access ice without the need to bend-over and without the need to open doors 126 and 128. In the exemplary embodiment, dispenser recess 150 is positioned at a level that approximates the chest level of a user.

Refrigerator doors 126, 128 are shown in the closed position in FIG. 1. One of the refrigerator doors, e.g., right door 126 as in the illustrated example, may optionally include an outer casing 121 (FIG. 3) comprising a thermally insulated wall 125 (FIG. 3) and a thermally insulated mullion 304, as illustrated, e.g., FIG. 1, positioned within the outer casing 121. The outer casing 121 and the mullion 304 define a first flexible chamber 300 and a second flexible chamber 302. The door, e.g., right door 126, may also include a front panel 127 rotatably mounted to the outer casing 121 to selectively sealingly enclose or permit access to the first and second flexible chambers 300 and 302. For example, the front panel 127 may permit access to the flexible chambers 300 and 302 when the door 126 is in the closed position, as shown for example in FIG. 1. The flexible chambers 300 and 302 may be selectively operable at a variety of temperatures.

In various embodiments, fresh food storage chamber 118 may be operable within a temperature range above the freezing point of water and below room temperature, such as between approximately thirty-three degrees Fahrenheit (33° F.) and approximately sixty degrees Fahrenheit (60° F.). Also by way of example, the freezer chamber 116 may be operable within a temperature range including temperatures below the freezing point of water, e.g., less than thirty-two degrees Fahrenheit (32° F.), such as between approximately thirty degrees Fahrenheit (30° F.) and approximately zero degrees Fahrenheit (0° F.). For example, a temperature of the fresh food storage chamber 118 may be about forty degrees Fahrenheit (40° F.) or about forty-five degrees Fahrenheit (45° F.) and a temperature of the freezer chamber 116 may be about fifteen degrees Fahrenheit (15° F.) or about twenty-five degrees Fahrenheit (25° F.). In various embodiments, a thermally insulated partition or mullion 200 may be provided within the cabinet 120, e.g., between the fresh food chamber 118 and the freezer chamber 116 (FIG. 3). The mullion 200 may separate the distinct chambers. The mullion 200 may be a horizontal mullion, e.g., mullion 200 may extend along a plane perpendicular to the vertical direction V, e.g., a plane defined by the lateral direction L and the transverse direction T. The thermally insulated mullion 200 may permit or enhance operation of the fresh food chamber 118 and the freezer chamber 116 at distinct temperatures.

The flexible chambers 300 and 302 may be selectively operable as either fresh food storage chambers or freezer chambers, e.g., within one of a first temperature range and a second temperature range. For example, the first and second flexible chambers 300 and 302 may be operable as fresh food storage chambers wherein the chambers 300 and 302 each provide an internal temperature within one or more of the fresh food storage temperature ranges described above, e.g., above the freezing point of water and below room temperature, such as between approximately thirty-three degrees Fahrenheit (33° F.) and approximately sixty degrees Fahrenheit (60° F.). The flexible chambers 300 and 302 may also be selectively operable to provide internal temperatures below the freezing point of water, e.g., between approximately thirty degrees Fahrenheit (30° F.) and approximately zero degrees Fahrenheit (0° F.), as described above.

One of ordinary skill in the art will recognize that the various chambers or portions may be chilled by a sealed refrigeration system, such that, e.g., the first flexible chamber 300 and the second flexible chamber 302 may be operable at or about the temperatures described above by providing chilled air from the sealed system. The structure and function of such sealed systems are understood by those of ordinary skill in the art and are not described in further detail herein for the sake of brevity and clarity.

It is to be recognized that the benefits of the present disclosure apply to other types and styles of refrigerator appliances such as, e.g., a top mount refrigerator appliance, a side-by-side style refrigerator appliance or a standalone refrigerator-only or freezer-only appliance. Consequently, the description set forth herein is for illustrative purposes only and is not intended to be limiting in any aspect to any particular configuration, such as not limiting to any particular refrigerator chamber configuration. Accordingly, the description herein of, e.g., the through-door dispenser, the door-in-door configuration with flexible chambers 300 and 302, among other features, are by way of example only. Using the teachings disclosed herein, one of skill in the art will understand that the present subject matter can be used with any other style or model of refrigerator appliance.

Referring now specifically to FIG. 3, an articulating lip 220 may be coupled to the mullion 200. As illustrated in FIG. 3, the articulating lip 220 may include a bearing surface which provides sealing engagement with at least one of the doors 126, 128, and/or 130 when the respective door or doors is or are in the closed position. For example, the articulating lip 220 may sealingly engage one or more gaskets 160 on the corresponding door(s). Also as may be seen in FIG. 3, one of the drawers 204 may be located within one of the chilled chambers, e.g., the fresh food storage chamber 118, behind the articulating lip 220 when the drawer 204 is in a retracted position. Accordingly, as will be described in more detail below, the articulating lip 220 may permit the drawer 204 positioned therebehind to be relatively larger, e.g., deeper along the vertical direction V, as compared to a construction where the mullion 200 alone sealingly engages the gaskets 160. This is so because such construction would require a mullion that is thicker, e.g., along the vertical direction V, than the mullion 200 illustrated in FIG. 3, resulting in reduced volume of the fresh food storage chamber 118, and reduced volume of the drawer 204 adjacent to the mullion.

Figure 5:
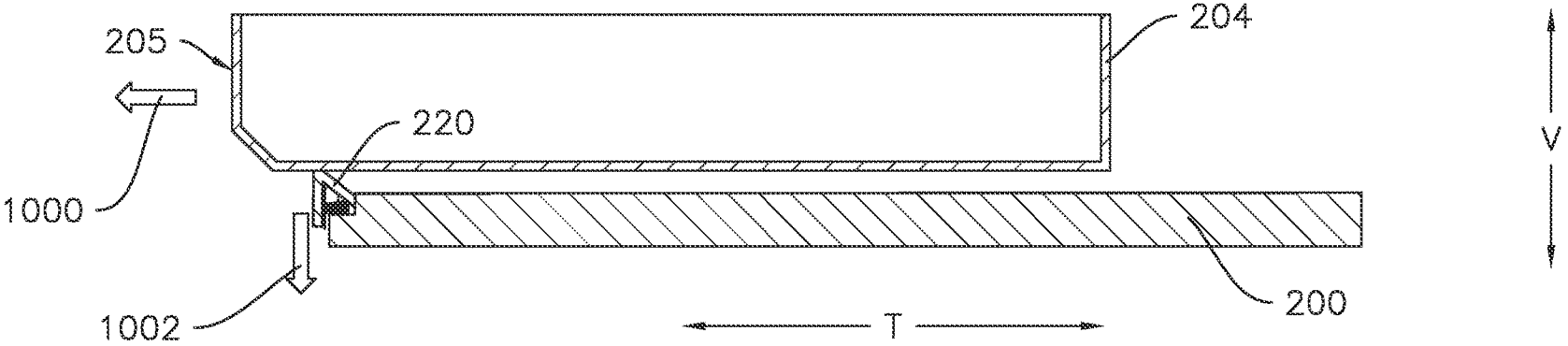
FIG. 5 provides a view of the drawer and mullion of FIG. 4 with the drawer in an extended position.
Figure 7:
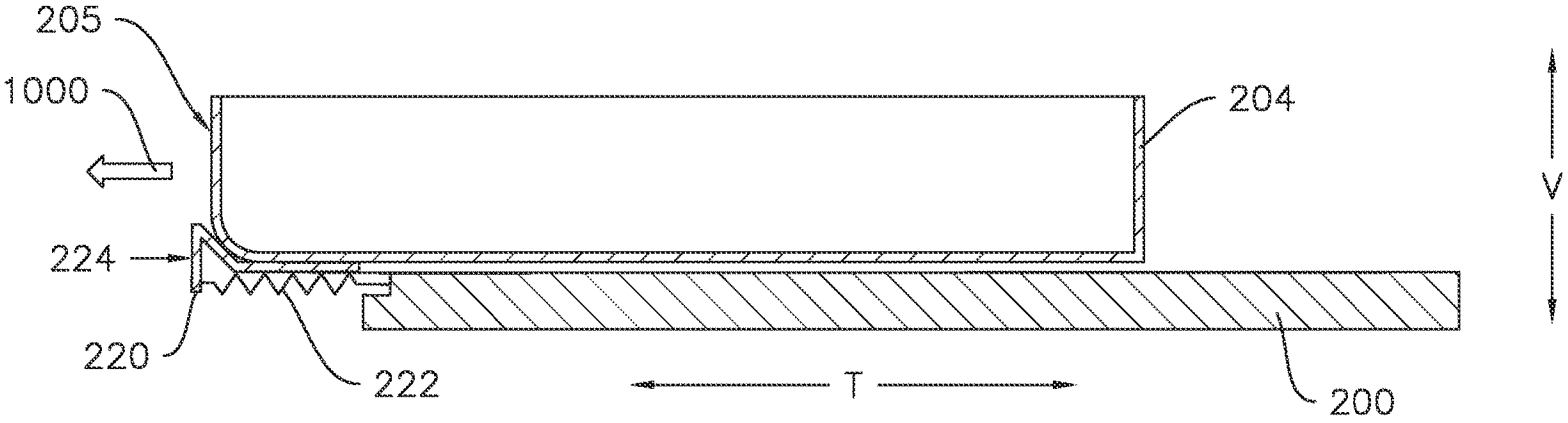
FIG. 7 provides a view of the drawer and mullion of FIG. 6 with the drawer in an extended position.
Figure 9:
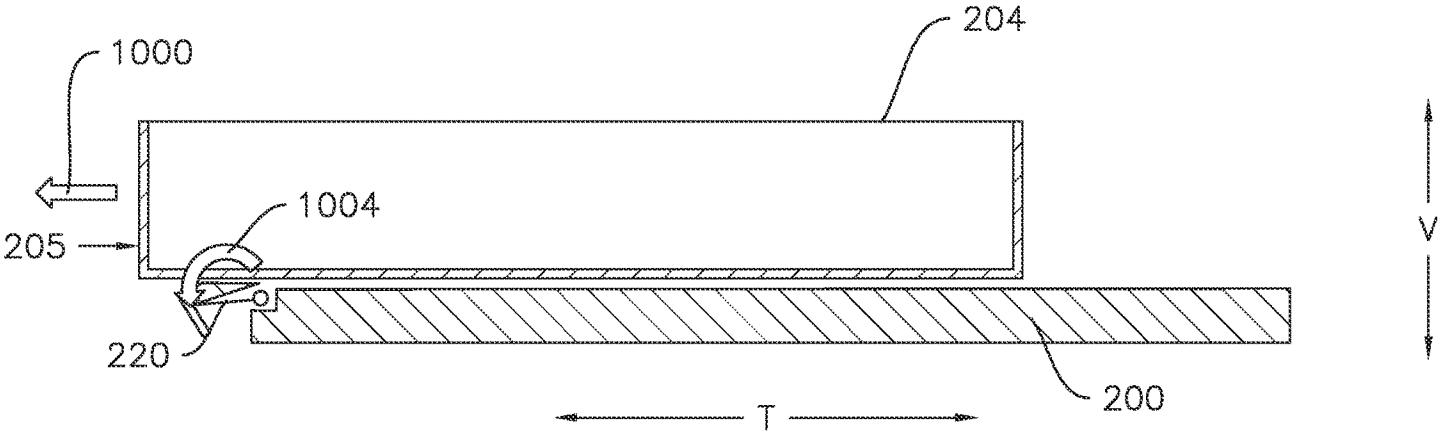
FIG. 9 provides a view of the drawer and mullion of FIG. 8 with the drawer in an extended position.

In order to provide access to the drawer 204 and/or contents thereof such as food items stored in the drawer 204, the articulating lip 220 may be movable relative to the mullion 200. For example, the drawer 204 may be slidably mounted within the fresh food chamber 118 so that the drawer 204 is movable along a path of travel, e.g., generally along the transverse direction T, between a retracted position and an extended position. Thus, the articulating lip 220 may be movable relative to the mullion 200 between a sealing position (e.g., FIG. 3) and an open position (FIGS. 5, 7, and 9). The articulating lip 220 may be in the path of travel of the drawer 204 when the articulating lip 220 is in the sealing position and the gasket(s) 160 mounted to the door 126, 128, and/or 130 may sealingly engage the bearing surface 224 of the articulating lip 220 when the articulating lip 220 is in the sealing position and the door(s) 126, 128, and/or 130 is or are in the closed position. As illustrated in FIGS. 5, 7, and 9 and described in more detail below, the articulating lip 220 is outside of the path of travel of the drawer 204 when the articulating lip 220 is in the open position. The articulating lip 220 may be coupled to the mullion 200 by a biasing element 222 and the biasing element 222 may bias the articulating lip 220 to the sealing position. The biasing element 222 may be designed and/or configured to provide minimal resistance to the movement of the drawer 204 along the path of travel of the drawer 204, such that the pull force required to move the drawer 204 forward past the articulating lip 220 would be minimal or within acceptable limits. For example, in embodiments where the biasing element 222 is one of the example springs described below, the spring constant may be selected such that the pull force required to move the drawer 204 forward past the articulating lip 220 would be minimal or within acceptable limits.

Figure 4:
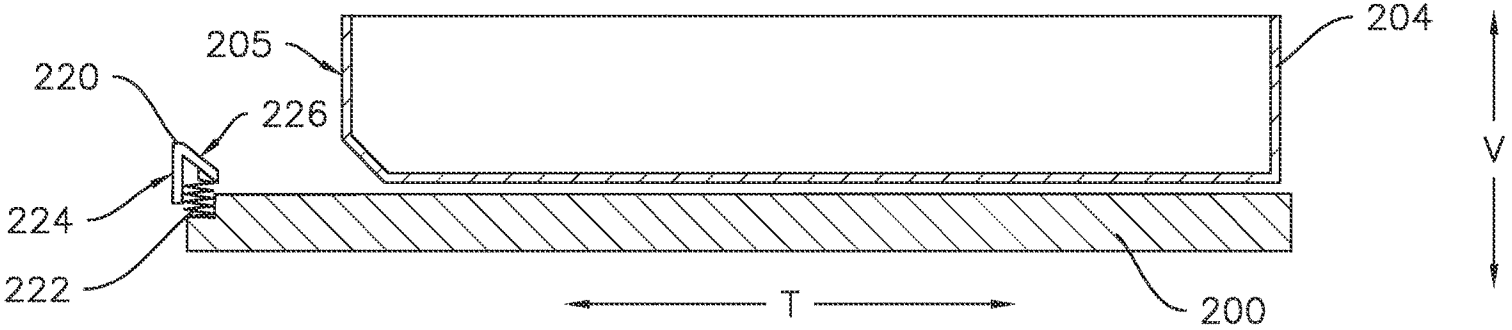
FIG. 4 provides a schematic illustration of an exemplary drawer and mullion for a refrigerator appliance according to one or more exemplary embodiments of the present subject matter.

In some embodiments, e.g., as illustrated in FIGS. 4 and 5, the biasing element 222 may be a coil spring and may be oriented along the vertical direction V. In such embodiments, the coil spring 222 (which is an embodiment of the biasing element 222) may be compressed downward along the vertical direction V when the articulating lip 220 is in the open position, e.g., as illustrated in FIG. 5. The drawer 204 is illustrated in the retracted position in FIG. 4. The drawer 204 may be movable along the path of travel between the retracted position illustrated in FIG. 4 and an extended position, such as the extended position illustrated in FIG. 5. It is to be recognized that the extended position illustrated in FIG. 5 is merely an example and may be a partially extended position, e.g., the drawer 204 may also be further slidable along the path of travel, e.g., forwards along the transverse direction T, to a fully extended position (not shown).

As may be seen in FIGS. 4 and 5, the drawer 204 may include a front surface 205 and the articulating lip 220 may include a rear surface 226. For example, the articulating lip 220 may include a first leg, e.g., a vertical leg, which extends generally along the vertical direction V and on which the bearing surface 224 is defined, as well as a second leg, e.g., an oblique leg, which extends at an oblique angle to the vertical leg and on which the rear surface 226 is defined. In some embodiments, e.g., as illustrated in FIGS. 4 through 9, the legs of the articulating lip 220 may meet at and collectively define an upper corner of the articulating lip 220. When the drawer 204 travels forward along the path of travel, e.g., as illustrated by arrow 1000 in FIG. 5, from the retracted position (FIG. 4) to or towards an extended position (e.g., FIG. 5), the front surface 205 of the drawer 204 engages the rear surface 226 of the articulating lip 220. As the drawer 204 continues travel along the path of travel towards the extended position, e.g., forward along the transverse direction T, the articulating lip 220 moves downward along the vertical direction V, e.g., as indicated by arrow 1002 in FIG. 5. Thus, the articulating lip 220 moves to the open position, e.g., as illustrated in FIG. 5, where the coil spring 222 is compressed and the articulating lip 220 is outside of the path of travel of the drawer 204, permitting the drawer 204 to continue to slide outward from the fresh food storage chamber 118. In some embodiments, the front surface 205 of the drawer 204 may include features for improved, e.g., smoother and/or more gradual, engagement with the articulating lip 220, such as a chamfered corner as illustrated in FIGS. 4 and 5.

Figure 6:
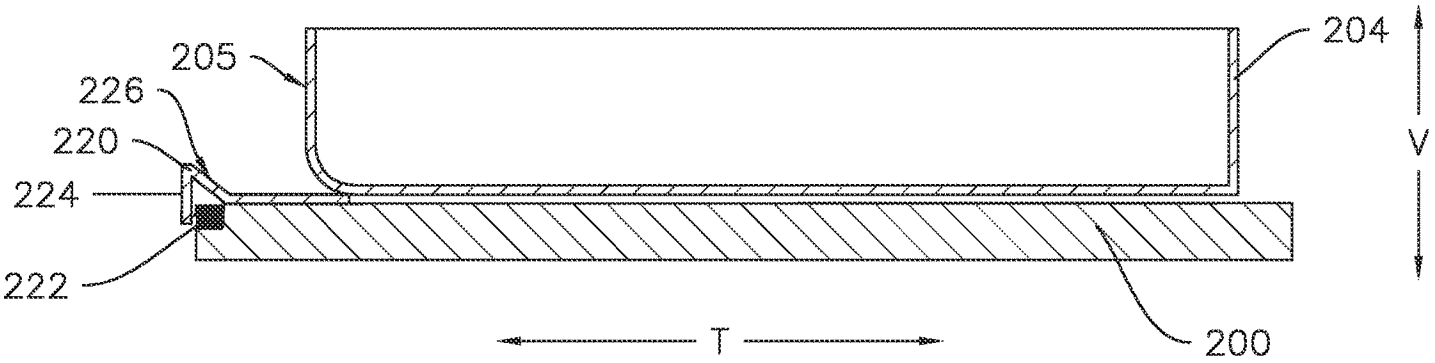
FIG. 6 provides a schematic illustration of an exemplary drawer and mullion for a refrigerator appliance according to one or more additional exemplary embodiments of the present subject matter.

In some embodiments, e.g., as illustrated in FIGS. 6 and 7, the biasing element 222 may be a coil spring and may be oriented generally along the transverse direction T. In such embodiments, when the front surface 205 of the drawer 204 bears on the rear surface 226 of the articulating lip 220 as the drawer 204 moves from the retracted position (FIG. 6) to the extended position (FIG. 7), the drawer 204 and the articulating lip 220 both move forward along the path of travel, e.g., as indicated by arrow 1000 in FIG. 7. As may be seen in FIG. 7, the biasing element 222, e.g., the transverse-oriented coil spring, is thereby in tension when the articulating lip 220 is in the open position. Additionally, as may be seen in FIG. 7 where the articulating lip 220 is illustrated in the open position, the articulating lip 220 is at least partially outside of the path of travel of the drawer 204 in that at least a portion, e.g., at least the first leg and the bearing surface 224 thereon, of the articulating lip 220 is forward of the drawer 204 at the fully extended position of the drawer 204, e.g., the first leg of the articulating lip 220 is closer to the front of the refrigerator appliance 100 than the farthest forward extent of the path of travel of the drawer 204. Also as illustrated in FIGS. 6 and 7, in some embodiments the front surface 205 of the drawer 204 may include a rounded or filleted corner to provide improved, e.g., smoother and/or more gradual, engagement with the articulating lip 220.

Figure 8:
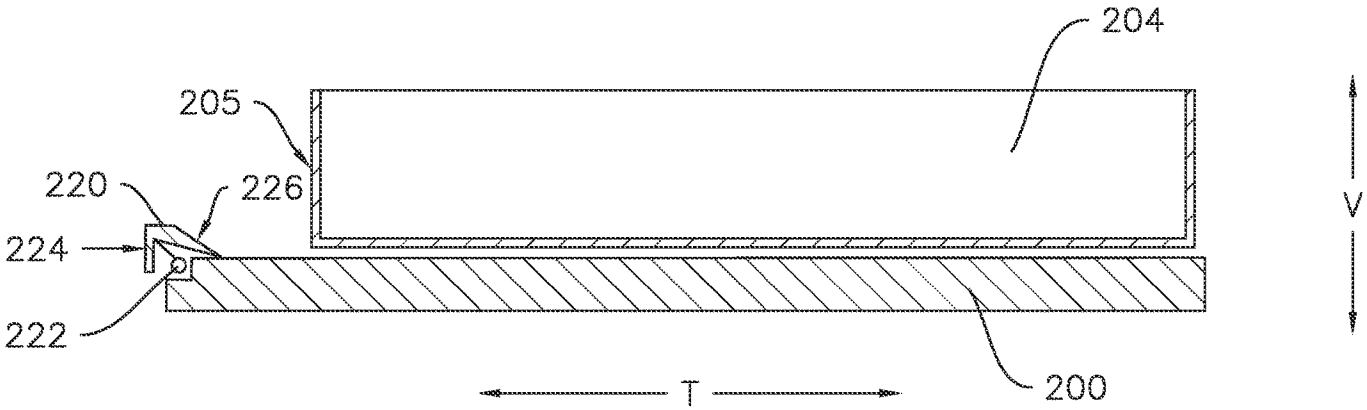
FIG. 8 provides a schematic illustration of an exemplary drawer and mullion for a refrigerator appliance according to one or more additional exemplary embodiments of the present subject matter.

Turning now to the exemplary embodiment illustrated in FIGS. 8 and 9, in some embodiments, the articulating lip 220 may be coupled to the mullion 200 by a torsion spring, where the torsion spring is an embodiment of the biasing element 222. In such embodiments, the articulating lip 220 may be rotatable, e.g., generally about the lateral direction L, such as along the rotational path indicated by arrow 1004 in FIG. 9, between the sealing position (FIG. 8) and the open position (FIG. 9). In some embodiments, the second leg of the articulating lip 220 may be a tapered oblique leg, e.g., as illustrated in FIGS. 8 and 9, to promote improved, e.g., smoother and/or more gradual, engagement of the front surface 205 of the drawer 204 and the rear surface 226 of the articulating lip 220. Additionally, the taper of the oblique leg of the articulating lip 220 may provide improved clearance between the lip 220 and the biasing element 222 and/or the drawer 204 when the articulating lip 220 is in the open position.

Figure 10:
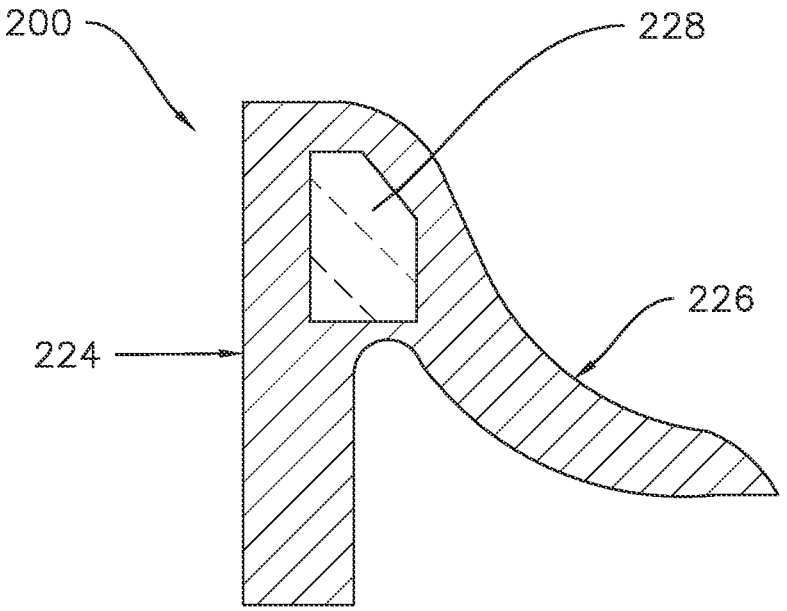
FIG. 10 provides a section view of an articulating lip for a refrigerator appliance according to one or more exemplary embodiments of the present subject matter.
Figure 11:
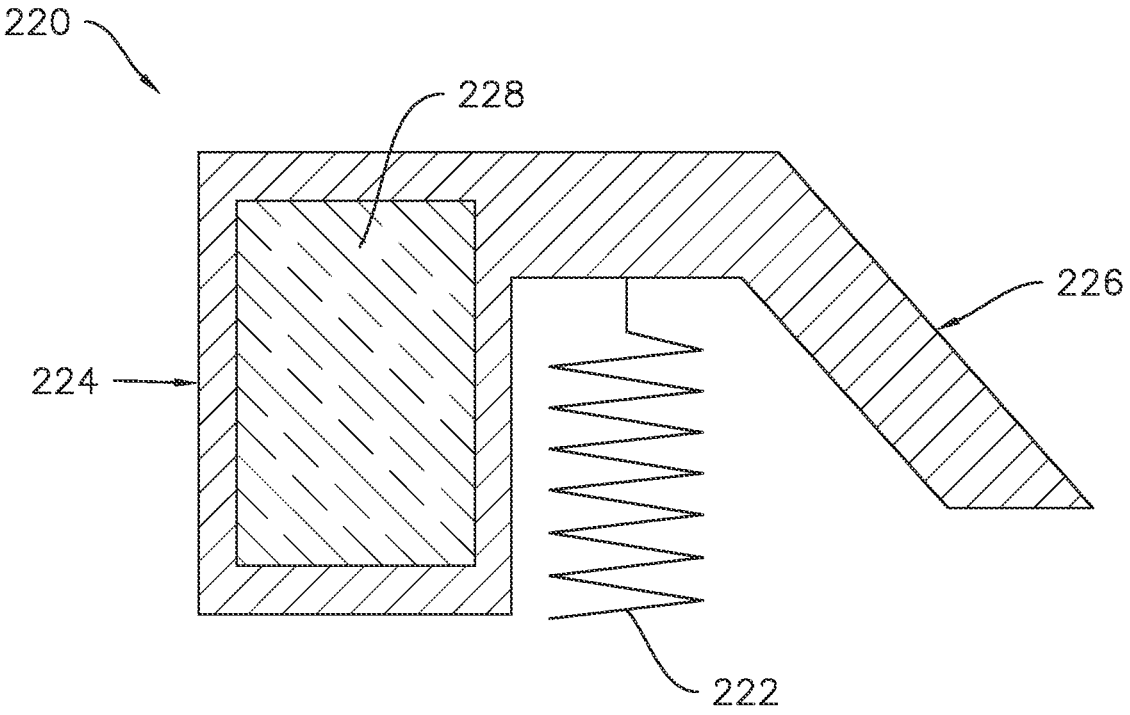
FIG. 11 provides a section view of an articulating lip for a refrigerator appliance according to one or more additional exemplary embodiments of the present subject matter.

In various embodiments, the articulating lip 220 may be at least partially insulated. For example, as illustrated in FIGS. 10 and 11, the articulating lip 220 may include thermal insulation 228 in a portion of the articulating lip 220. In some embodiments, e.g., as illustrated in FIG. 10, the second leg of the articulating lip 220 on which the rear surface 226 is defined may be curved, such as compound curved as illustrated in FIG. 10. In additional exemplary embodiments, e.g., as illustrated in FIG. 11, the second leg of the articulating lip 220 may be spaced apart from the first leg of the articulating lip 220, such that the first and second legs do not meet at an upper corner as described above, but rather each end at a respective end of a horizontal top of the articulating lip 220, as illustrated in FIG. 11.

As mentioned above, features illustrated or described as part of one embodiment can be used with another embodiment to yield a still further embodiment. For example, the articulating lips 220 illustrated in FIGS. 10 and 11 may be coupled to the mullion 200 by any of the exemplary biasing elements illustrated throughout FIGS. 4 through 9. As another example, the chamfered front corner of the drawer 204 illustrated in FIGS. 4 and 5 may be provided in additional exemplary embodiments where the articulating lip 220 is coupled to the mullion 200 with a transverse coil spring, e.g., as in FIGS. 6 and 7, or a torsion spring, e.g., as in FIGS. 8 and 9, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction and a transverse direction, the vertical, lateral and transverse directions being mutually perpendicular, the refrigerator appliance comprising:

a cabinet extending from a top to a bottom along the vertical direction, the cabinet also extending from a left side to a right side along the lateral direction, the cabinet defining a fresh food storage chamber and a freezer chamber, the fresh food storage chamber and the freezer chamber mutually separated by a mullion;

a fresh food door rotatably mounted to the cabinet whereby the fresh food door rotates between a closed position where the fresh food door sealingly encloses at least a portion of the fresh food chamber and an open position to permit access to the fresh food chamber;

a gasket mounted to the fresh food door;

a drawer slidably mounted within the fresh food chamber whereby the drawer is movable along a path of travel between a retracted position and an extended position;

an articulating lip coupled to the mullion, the articulating lip comprises a bearing surface, the articulating lip movable relative to the mullion between a sealing position wherein the articulating lip is in the path of travel of the drawer and an open position wherein the articulating lip is outside of the path of travel of the drawer, wherein the gasket mounted to the fresh food door sealingly engages the bearing surface of the articulating lip when the fresh food door is in the closed position.

2. The refrigerator appliance of claim 1, wherein the mullion is horizontal and extends along a plane defined by the lateral direction and the transverse direction.

3. The refrigerator appliance of claim 1, wherein the mullion is thermally insulated.

4. The refrigerator appliance of claim 1, wherein the articulating lip is coupled to the mullion by a coil spring.

5. The refrigerator appliance of claim 4, wherein the coil spring is oriented along the vertical direction, wherein the coil spring is compressed downward along the vertical direction when the articulating lip is in the open position.

6. The refrigerator appliance of claim 4, wherein the coil spring is oriented along the transverse direction, wherein the coil spring is in tension along the transverse direction when the articulating lip is in the open position.

7. The refrigerator appliance of claim 1, wherein the articulating lip is coupled to the mullion by a torsion spring, and wherein the articulating lip is configured to rotate between the sealing position and the open position.

8. The refrigerator appliance of claim 1, wherein the drawer comprises a front face, the front face of the drawer configured to engage a rear surface of the articulating lip as the drawer moves from the retracted position to the extended position.

9. A refrigerator appliance defining a vertical direction, a lateral direction and a transverse direction, the vertical, lateral and transverse directions being mutually perpendicular, the refrigerator appliance comprising:

a cabinet extending from a top to a bottom along the vertical direction, the cabinet also extending from a left side to a right side along the lateral direction, the cabinet defining a fresh food storage chamber and a freezer chamber, the fresh food storage chamber and the freezer chamber mutually separated by a mullion;

a door movably mounted to the cabinet whereby the door is movable between a closed position where the door sealingly encloses at least a portion of one of the fresh food chamber and the freezer chamber and an open position to permit access to the one of the fresh food chamber and the freezer chamber;

a gasket mounted to the door;

an articulating lip coupled to the mullion, the articulating lip comprising a bearing surface, the articulating lip movable relative to the mullion between a sealing position and an open position, wherein the gasket mounted to the door sealingly engages the bearing surface of the articulating lip when the articulating lip is in the sealing position and the door is in the closed position; and a drawer slidably mounted within the one of the fresh food chamber and the freezer chamber whereby the drawer is movable along a path of travel between a retracted position and an extended position, the drawer positioned entirely within the one of the fresh food chamber and the freezer chamber and behind the articulating lip when the drawer is in the retracted position, wherein the articulating lip is in the path of travel of the drawer when the articulating lip is in the sealing position and wherein the articulating lip is outside of the path of travel of the drawer when the articulating lip is in the open position.

10. The refrigerator appliance of claim 9, wherein the mullion is horizontal and extends along a plane defined by the lateral direction and the transverse direction.

11. The refrigerator appliance of claim 9, wherein the mullion is thermally insulated.

12. The refrigerator appliance of claim 9, wherein the articulating lip is coupled to the mullion by a biasing element, the biasing element configured to bias the articulating lip to the sealing position.

13. The refrigerator appliance of claim 12, wherein the biasing element is a coil spring oriented along the vertical direction, wherein the coil spring is compressed downward along the vertical direction when the articulating lip is in the open position.

14. The refrigerator appliance of claim 12, wherein the biasing element is a coil spring oriented along the transverse direction, wherein the coil spring is in tension along the transverse direction when the articulating lip is in the open position.

15. The refrigerator appliance of claim 12, wherein the biasing element is a torsion spring, and wherein the articulating lip is configured to rotate between the sealing position and the open position.

16. The refrigerator appliance of claim 9, wherein the door is a fresh food door.

17. The refrigerator appliance of claim 9, wherein the door is a freezer door.

* * * * *